US007000519B1

(12) United States Patent
Weinstein et al.

(10) Patent No.: US 7,000,519 B1
(45) Date of Patent: Feb. 21, 2006

(54) JOINTER CLAMP

(75) Inventors: Burton Weinstein, New York, NY (US); Richard H. Deaton, New York, NY (US)

(73) Assignee: Simp'l Products, INC, Mt. Vernon, NY (US)

( * ) Notice: Subject to any disclaimer, the term of this patent is extended or adjusted under 35 U.S.C. 154(b) by 219 days.

(21) Appl. No.: 10/768,624

(22) Filed: Jan. 30, 2004

(51) Int. Cl.
*B26D 7/06* (2006.01)
*B27B 27/02* (2006.01)

(52) U.S. Cl. ..... 83/435.27; 83/425; 83/437.1; 83/438; 83/442; 83/454; 83/477.2; 144/287; 269/152; 269/154; 269/164; 269/249

(58) Field of Classification Search ..... 83/415, 83/425, 435.11, 435.12, 435.13, 435.14, 437.27, 83/437.1, 438, 442, 452, 453, 454, 464, 477.2, 83/648, 720, 721, 730; 144/287; 269/152, 269/154, 164, 249
See application file for complete search history.

(56) References Cited

U.S. PATENT DOCUMENTS 1,566,225 A * 12/1925 Mills ..... 269/315
2,759,503 A * 8/1956 Goldschmidt ..... 83/425 X
3,051,204 A * 8/1962 Gaskell ..... 83/435.14 X
3,575,405 A * 4/1971 Harding ..... 269/249 X
4,234,176 A * 11/1980 Goff et al. ..... 269/249 X
4,432,263 A * 2/1984 Kowalchuk ..... 83/438
4,628,782 A * 12/1986 Park ..... 83/442
5,176,058 A * 1/1993 Skelly ..... 83/415
5,694,993 A * 12/1997 Cameron ..... 83/425 X
5,823,084 A * 10/1998 Ramey ..... 83/415

OTHER PUBLICATIONS

Joint'r, Ad page from website, 1 page, 2003.
Joint'r clamp, Instruction pages from website, 2 pages, 2003.

* cited by examiner

*Primary Examiner*—Clark F. Dexter
(74) *Attorney, Agent, or Firm*—Gordon D. Coplein

(57) ABSTRACT

A clamp to make a straight edge on a working board has a base with a lower surface to slide on a table saw and a main wall that extends upward from the base. A lower support extends outwardly from the main wall in opposite directions, and two upper supports extend outwardly from the main wall in opposite directions to define channels, wherein a reference board is placed in one channel and the working board in the other channel. A shim arm is pivotally mounted to and extends along the base. A shim support pad is mounted at the free end of the arm and its upper surface is in the same plane as the upper surface of the base. The shim arm swings out from the base so that the pad forms a support on which the working board rests to effectively increase the width of the base.

13 Claims, 2 Drawing Sheets

JOINTER CLAMP

FIELD OF THE INVENTION

The present invention relates to a jointer clamp that permits a table saw to be used to square the edge of a board.

BACKGROUND OF THE INVENTION

A jointer is a machine used in the woodworking field to square, that is, make the edge of a board straight and make it perpendicular to the board upper or lower surface. A typical jointer is a specialized machine that has a fence against which the board edge is pushed to interact with a group of knives rotating at high speed. A person who practices woodworking on a limited basis, such as a hobbyist, often does not own a dedicated jointer since the cost is not justified for its relatively limited use.

Such a casual woodworker has been provided an inexpensive substitute in a device called JOINT'R CLAMP KIT, that was invented and is now being sold by SIMP'L PRODUCTS of Mount Vernon, N.Y. This device, as shown in FIG. 1, is used with a common table saw that is owned by many casual woodworkers. This clamp kit accomplishes the task of squaring an edge E of a working board B. The kit includes a pair of specialized bi-level clamps 10 of the same construction that are used with a reference board R that has a straight edge RS. The clamp 10, which is an aluminum extrusion, has a base 12 that is to rest and slide on the table T of the saw. A plurality of spaced raised ribs 14 extend on the bottom of clamp base 12 in the direction of which it is to slide on the table T of the table saw to reduce sliding friction. A main wall 16 extends vertically upwardly from near the center of the upper surface of base 12. A lower clamp support wall 18 extends horizontally outwardly from and transverse to the base main wall 16 and an upper clamp support wall 20 extends outwardly from and transverse to the main wall 16 in the opposite direction to lower support wall 18. A threaded hole 18*a* and 20*a* is provided in each of the lower and upper support walls 18 and 20 to accept a respective thumbscrew 18*b* and 20*b*.

The space between the base 12 upper surface and the lower surface of the lower support wall 18 forms a channel C1 in which one edge of the reference board opposite the reference straight edge RS is placed to engage the clamp main wall 16. The space between the base 12 upper surface and the under surface of the upper support wall 20 forms another channel C2 in which the edge of the board B opposite to the one being squared is placed to engage the clamp main wall 16. The main wall 16 also has ribs on both sides which the edges of the boards R and B engage. The edges of boards R and B that engage the main wall 16 do not have to be squared.

In the use of the kit, a rabbet 23 is made in the lower surface of the reference board R. The outer edge of the part of the base 12 that forms the channel C1 fits in the reference board rabbet 23. The rabbet 23 has a depth selected so that the lower ends of the clamp base ribs 14 and the lower surface of the reference board R will be in the same plane when sliding on the saw table T. One clamp 10 is placed near each end of the reference board R which is clamped in the channel C1 by tightening the thumbscrew 18*b*. One edge of the working board B is inserted into the channel C2 of each of the two clamps 10 to engage against their respective main walls 16. The working board B is secured in channel C2 by tightening the thumbscrews 20*b* of the two clamps. The edge of the working board B that is to be squared is remote from the main wall 16 of each clamp.

The channel C2 preferably is of greater height than the channel C1 so that the working board B can be thicker than the reference board R. But this is not absolutely necessary. The reference board R can be, for example, a 1"×3" piece of stock lumber that has actual dimensions of ¾'×2¾" and can be from 2 to 3 feet long. A reference board of any suitable dimensions can be used as long as the edge that is to ride against the table saw adjustable rip fence is squared. In a commercial version of the clamp 10 the height of the channel C1 is about 1" and that of the channel C2 about 2.5". The width of the lower support wall 18 extending horizontally from the vertical main wall 16 is about 1", the width of the upper support wall 20 is about 1.5" and that of the base 12 is about 3". The length of the base is about 2.5". These dimensions are not critical.

The table saw rip fence 27 is set to the desired distance from the saw blade 31 to determine the point in the working board B at which to make the squared edge. The straight edge RS of the reference board R is guided against the table saw rip fence 27 and the saw blade 31 makes the cut to form the edge E in the working board. The saw cut will produce a straight and squared edge E since the straight edge RS of the reference board is being guided against the table saw rip fence 27, which is a straight edge parallel to the rotating saw blade 31.

The jointer clamp set kit of FIG. 1 generally operates in a satisfactory manner. However, if the width of the working board B is much greater than the width of the portion of base 12 that forms the channel C2 on which a part of working board B rests, particularly when the working board is thick and/or heavy, the working board in the clamp channel C2 may tilt down slightly from the plane of the upper surface of the base 12. Therefore, when the saw blade 31 makes the cut to form the edge E in the working board, the cut might be slightly tilted relative to a true perpendicular from the surface T of the saw table and the surfaces of the working board. Therefore, the edge E cut by the saw blade 31 will not be truly square to the working board top surface. Accordingly, it is desirable to improve the clamp set of FIG. 1. to be able to overcome this problem.

BRIEF DESCRIPTION OF THE INVENTION

In accordance with the invention, a clamp set kit is provided to make a straight edge on a working board by using a table saw. Each of the clamps of the kit is of the same construction and has a base with a lower surface preferably having ribs that are to slide on the table of a table saw. A main wall extends vertically upward from the base upper surface. A lower support extends horizontally transversely outward from the main vertical wall and an upper support above the lower support extends horizontally transversely outwardly from the main wall in the opposite direction to define a respective channel with the base upper surface. A thumbscrew extends down from each of the lower and upper horizontal support walls into each of the channels. One edge of a reference board with a squared edge at the opposite side of the board is secured in one channel and an edge of a working board whose outer edge is to be squared is secured in the other channel.

To enhance the support of the working board, one end of a shim arm is pivotally mounted at one end of the base part that forms the channel below the upper support wall in which one edge of the working board is placed. The shim arm extends along the outer edge of this base part and is of the same length as the base part edge. A shim support pad is mounted at the free end of the pivotal arm and its upper surface is in the same plane as the upper surface of the clamp base on which the working board is supported. The shim arm swings out from the base so that the shim support pad forms a support on which the lower surface of the working board rests. This effectively increases the width of the base part that forms the channel for the working board and provides a wider support for the working board outwardly of the clamp base. This prevents the working board from tilting as it is being pushed over the saw table into the rotating saw blade.

BRIEF DESCRIPTION OF THE DRAWINGS

Other objects and advantages of the present invention will become more apparent upon reference to the following specification and annexed drawings, in which.

DETAILED DESCRIPTION OF THE INVENTION

Figure 1:
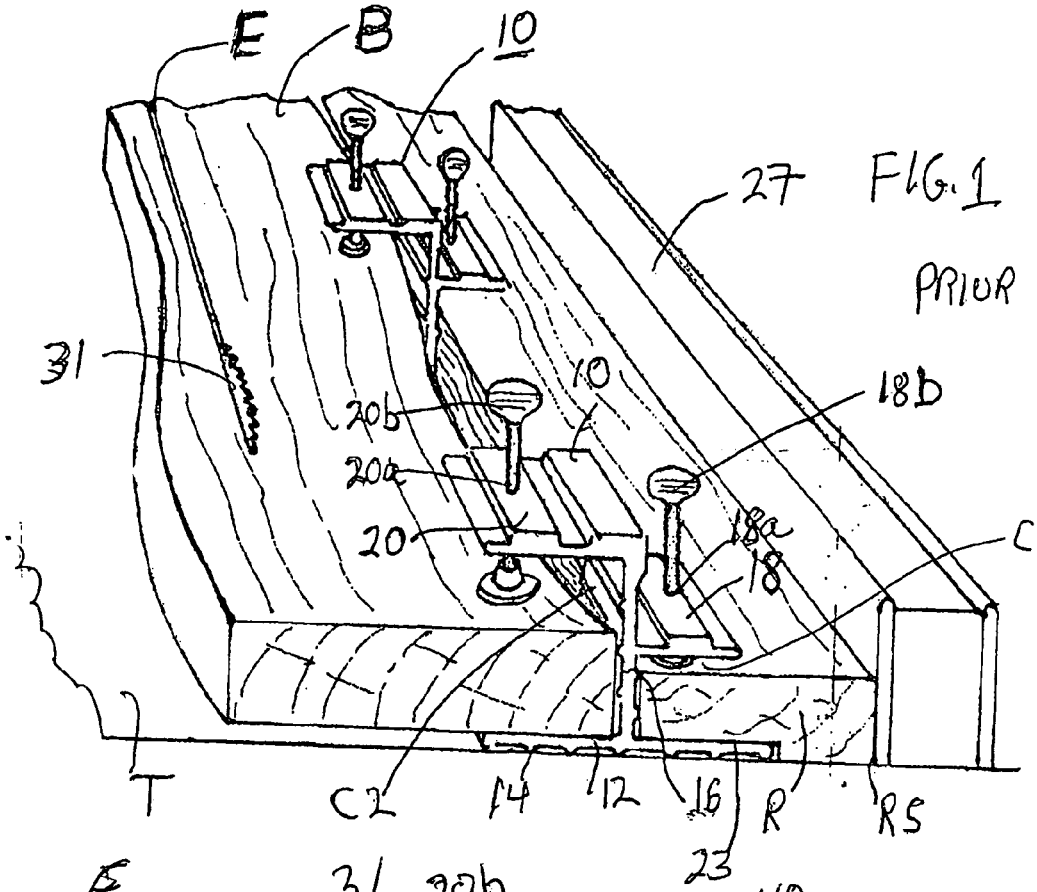
FIG. 1 PRIOR ART
FIG. 1 is a perspective view of the prior art jointer clamp set.

The clamp 40 of the present invention is shown in FIGS. 2A–2C and FIG. 3 and is described with reference to the clamp 10 of FIG. 1. The same elements are designated by the same reference numbers and have the same function.

A shim support arm 52 is provided under the lower surface of the edge of the section of base 12 that forms channel C2. One end of arm 52 is pivotally mounted at one end of the base and the arm is of the same length as the length of the base. The shim support arm 52 has a thickness that is the same as or less than the distance from the lower surface of base 12 to the lower end of the ribs 14 that are to ride on the saw table T. This permits the arm 52 to be moved from a first position that lies along the base edge to a second position in which it is extended generally transverse at 90° to the base as shown in each of FIGS. 2A–2C and FIG. 3 and not adversely affect the sliding of the clamp ribs 14 on the saw table T. The arm 52 can be extended to an intermediate position of less than 90°.

The pivotal mounting can be any suitable device, such as a rivet 55. A rabbet 42 is formed in the upper surface of the edge of the part of base 12 that forms the channel C2 for the working board so that the head 55*a* of the rivet 55 is below the upper surface of base 12. This permits flat placement of the working board edge on the base 12 upper surface in the channel C2 without interference by the rivet. The base end 55*b* of the rivet 55 is in a countersink 57 in the end of arm 52. Therefore, the rivet 55 and the arm 52 do not interfere with the sliding action of ribs 14 on the saw table T. The lower surface of the arm 52 can be a sliding surface on the saw table T like one of the ribs 14.

A shim pad 53 is mounted on the upper part of the free end of arm 52 remote from rivet 55. Pad 53 has a thickness such that its upper surface is in the same plane as that of the upper surface of the base part that forms the channel C2. Arm 52 has a length such that when it is folded in the rest position lying along the base length and is not extended from the base, the support pad 53 lies outside of the end of the base.

Figure 3:
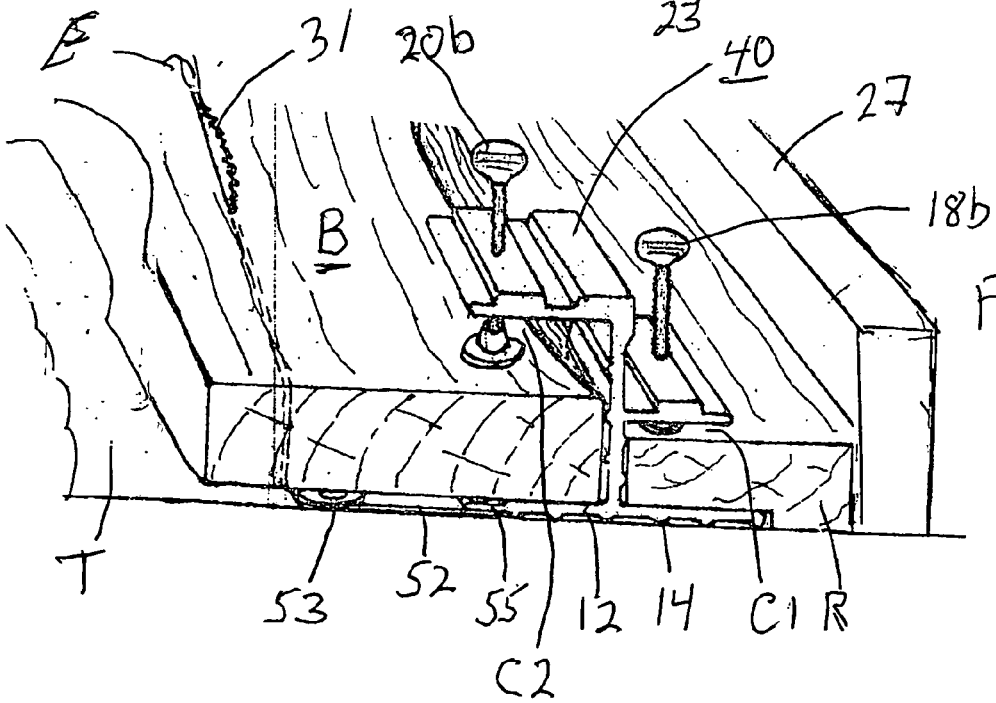
FIG. 3 is a perspective view of the clamp of the invention as being used.
Figure 2A:
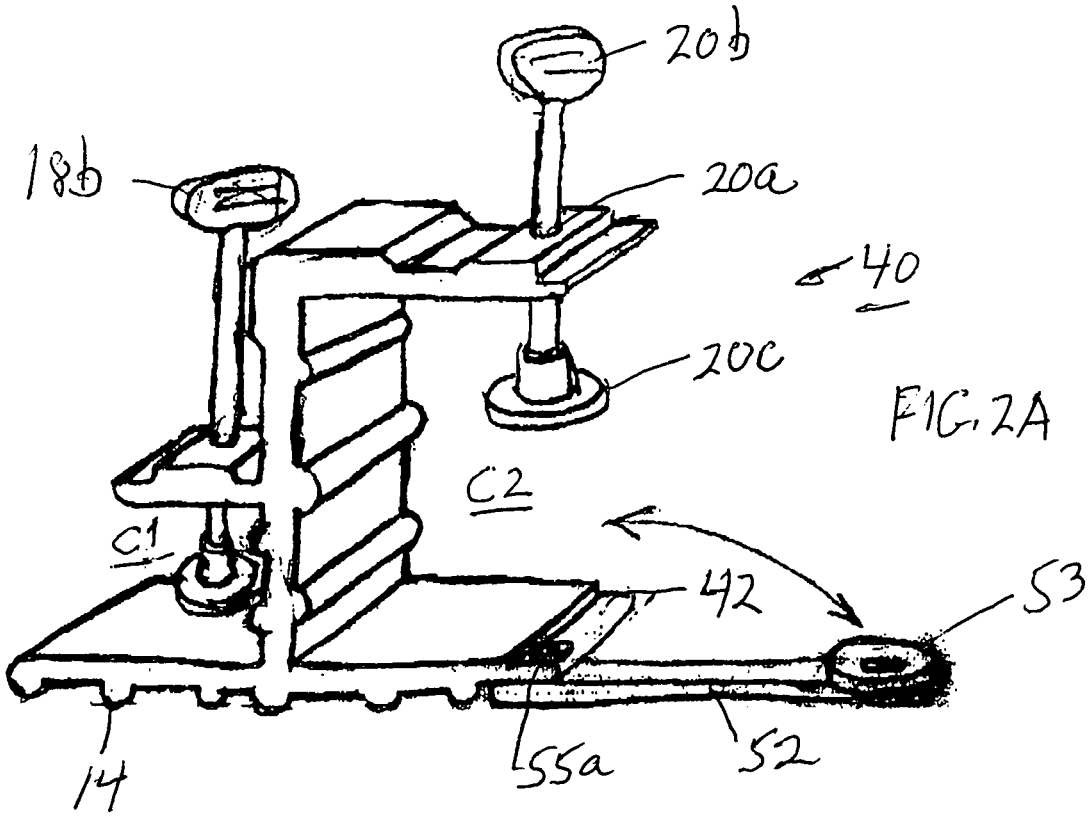
FIG. 2A is an elevational perspective view of the clamp in accordance with the invention.
Figure 2B:
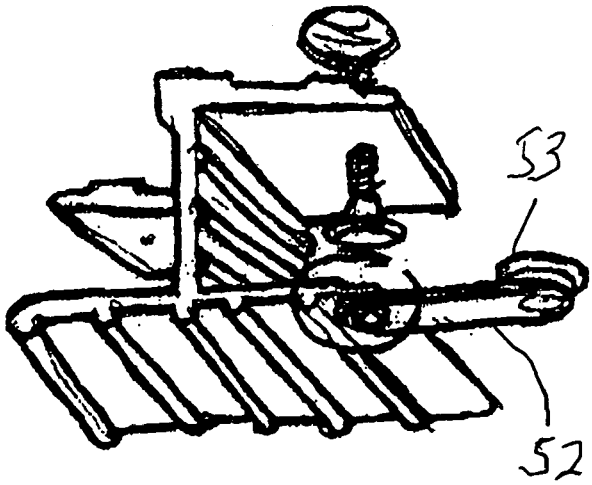
FIG. 2B is a perspective view from the underside of the clamp of FIG. 2A.
Figure 2C:
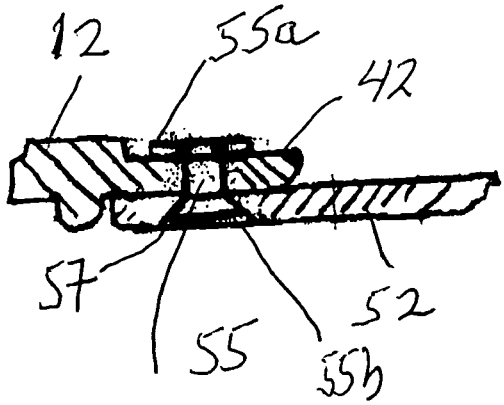
FIG. 2C is a side elevational view of a portion of the clamp of FIG. 2A showing the connection of the pivoting shim support arm to the clamp base.

As seen in FIG. 3, the clamp 40 of the invention is used substantially in the same manner as the clamp 10 previously described by inserting one edge of the reference board R in the channel C1 of two clamps against the main wall 16 and then tightening the thumbscrew 18*b* of each of the clamps to fasten the reference board in the channel C1 of each clamp. To accommodate a working board B in the case that such board is heavy or of a large width the arm 52 of each clamp 40 is pivoted to extend out from the clamp base so that the working board rests on the shim pad 53 of each clamp. The edge of the working board is moved into the channel C2 of each clamp against the clamp main wall 16 and the clamp thumbscrew 20*b* is tightened to secure the working board edge in the channel C2 of each clamp. The arms 52 and shim pads 53 effectively extend the width of the base part of the channels C2 of the clamps.

The saw rip fence is adjusted to set the point at which the cut is to be made in the working board by the rotating saw blade. Care should be taken that this point lies outside of the extension of the arm 52 and shim pad 53 so that they will not be cut. In a situation where the working board B is relatively narrow, the arms 52 will be only partially extended, say at 45° instead of 90°. The reference board straight edge RS is placed against the table saw rip fence 27 and is pushed forward so that the saw blade 31 will cut and square the edge E of the working board. The extended support arms 52 and pad 53 do not interfere with the sliding action of the clamps and the boards R and B on the saw table T. When the edge of a working board that does not need the extended support provided by support arm 52 is placed in the channel C2, the arm 52 of the clamp 40 is folded to lie along the edge of the clamp.

While the embodiment of the clamp of the invention described has a plurality of raised ribs 27 on the lower surface of the base 12, the base lower surface can be flat and a rabbet cut in the lower surface of the base along its outer edge to accept the arm 52 which would have a thickness less than the depth of the rabbet.

Specific features of the invention are shown in one or more of the drawings for convenience only, as each feature may be combined with other features in accordance with the invention. Alternative embodiments will be recognized by those skilled in the art and are intended to be included within the scope of the claims.

We claim:

1. A clamp to support a working board whose edge is to be squared by moving it along the table of a saw into a saw blade, said clamp comprising:

a base having a lower surface that is to slide on the saw table;

a main support wall extending vertically from said base;

a first support wall extending horizontally from and transverse to said main support wall to define a channel between the upper surface of said base and the lower surface of said first support wall to accept an edge of the working board on the upper surface of said base;

a thumbscrew extending downwardly from said first support wall to engage the working board upper surface; and a shim support pivotally mounted to said base to swing outwardly of said base and provide support for the working board lower surface, wherein said shim support has an upper surface that forms a support surface that is substantially coplanar with the upper surface of said base, said shim support pivoting in a plane that is substantially coplanar or substantially parallel to the upper surface of said base.

2. A clamp as claimed in claim 1 wherein said shim support comprises an arm having one end pivotally mounted to said base, said arm being positioned on the lower surface of said base.

3. A clamp as claimed in claim 2 wherein said arm is located in an area of said base lower surface that is recessed relative to the part of the base lower surface that is to slide on the saw table.

4. A clamp as claimed in claim 3 and further comprising:

a plurality of raised ribs on the lower surface of said base to slide on the saw table with at least one of said ribs forming said recessed area; and wherein said shim support arm has a thickness less than the height of said plurality of ribs.

5. A clamp as claimed in claim 3 wherein said shim support further comprises a support pad on the free end of said pivotally mounted arm having an upper surface that forms at least a portion of said support surface.

6. A clamp as claimed in claim 5 wherein the length of said arm extends the length of said base so that said support pad lies outside of said base when said arm is pivoted to lie along the length of said base.

7. A clamp as claimed in claim 1 and further comprising:

a second support wall extending horizontally outward from and transverse to said main support wall and in a direction opposite to said first support wall to define a second channel to accept one edge of a reference board whose other edge is to ride against a rip fence of the table saw; and a thumbscrew in said second support wall to extend into the second channel to engage the reference board.

8. A clamp as claimed in claim 7 wherein said first support wall is at a greater height from the upper surface of said base than said second support wall.

9. A clamp as claimed in claim 7 wherein said shim support comprises an arm having one end pivotally mounted to said base, said arm being positioned on the lower surface of said base.

10. A clamp as claimed in claim 9 wherein said arm is located in an area of said base lower surface that is recessed relative to the part of the base lower surface that is to slide on the saw table.

11. A clamp as claimed in claim 10 and further comprising:

a plurality of raised ribs on the lower surface of said base to slide on the saw table with at least one of said ribs forming said recessed area; and wherein said shim support arm has a thickness less than the height of said plurality of ribs.

12. A clamp as claimed in claim 10 wherein said shim support further comprises a support pad on the free end of said pivotally mounted arm having an upper surface that forms at least a portion of said support surface.

13. A clamp as claimed in claim 12 wherein the length of said arm extends the length of said base so that said support pad lies outside of said base when said arm is pivoted to lie along the length of said base.

* * * * *